United States Patent [19]

Washington

[11] 4,138,798

[45] Feb. 13, 1979

[54] ROTATING TOY

[76] Inventor: Joseph Washington, 11806 S. Watkins, Chicago, Ill. 60643

[21] Appl. No.: 778,562

[22] Filed: Mar. 17, 1977

[51] Int. Cl.[2] ..... A63H 1/32

[52] U.S. Cl. ..... 46/59; 46/62

[58] Field of Search ..... 46/47, 59, 62

[56] References Cited

U.S. PATENT DOCUMENTS

| | | | |
|---|---|---|---|
| 836,050 | 10/1906 | Pfleghardt | 46/59 |
| 1,099,081 | 6/1914 | Cautin et al. | 46/62 |
| 3,729,861 | 5/1973 | Lemoine | 46/59 |

*Primary Examiner*—Louis G. Mancene
*Assistant Examiner*—Robert F. Cutting
*Attorney, Agent, or Firm*—Thomas R. Vigil

[57] ABSTRACT

A rotating toy including a rotor fixed to a shaft. A ball is mounted on each end of the shaft and a handle slidable back and forth on the shaft is mounted on the shaft between the rotor and each ball. A string is connected between each handle and each ball on opposite sides of the shaft. The handles are used to twist the strings and are held while the strings untwist and retwist causing the balls, shaft and rotor to rotate in opposite directions as the handles are moved axially of the shaft toward and away from each other.

5 Claims, 3 Drawing Figures

ROTATING TOY

BACKGROUND OF THE INVENTION

This invention relates to rotating toys of the type wherein a rotor is rotated at high speed in opposite directions by means of a cord which alternately twists and untwists.

The general method of operation of the type of toy involved herein is well known and briefly involves the use of a rotor of some sort rotated at high speed by means of a loop of a string which is twisted so that when it is alternately tensioned and relaxed the twist of the string reverses and causes reversal of the direction of rotation of the rotor. An example of such a toy is shown in U.S. Pat. No. 3,302,322 and includes a string which is passed through parallel bores in the rotor, which is the usual method of mounting the rotor. This invention provides a toy of this type with a more interesting and enjoyable motion and effect.

SUMMARY OF THE INVENTION

In accordance with the invention, a rotor or wheel is fixed to a shaft. A rubber ball is mounted on each end of the shaft. A handle element is slidably mounted on the shaft between the rotor and each ball. A pair of elastic strings are connected between each handle and ball on opposite sides of the shaft. The handles are used to twist each string and are held as the strings untwist and retwist in the opposite direction rotating the balls and shaft and move back and forth relative to the shaft. Rotation of the shaft will also rotate the rotor fixed to the shaft in opposite directions.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
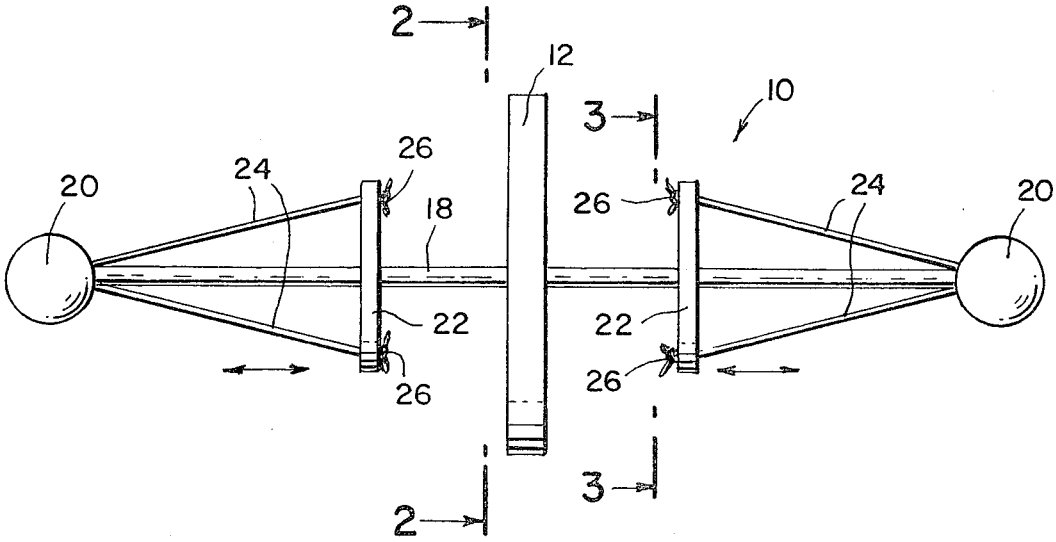
FIG. 1 is a side view in elevation of the toy of the present invention.
Figure 2:
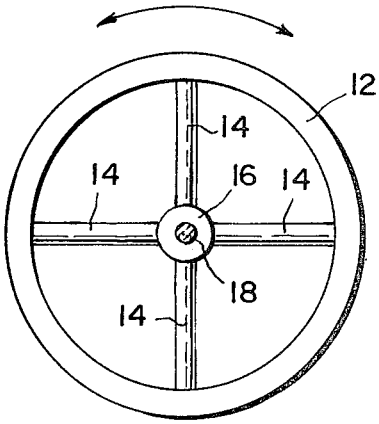
FIG. 2 is a cross-sectional view taken substantially along the plane indicated by line 2—2 of FIG. 1.
Figure 3:
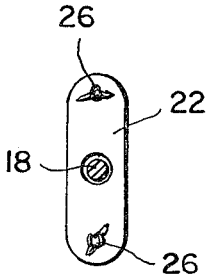
FIG. 3 is a cross-sectional view taken substantially along the plane indicated by line 3—3 of FIG. 1.

Referring now to the drawing in detail, wherein like numerals indicate like elements throughout the several views, the toy 10 of the present invention includes a rotor or wheel 12 having spokes 14 connected to a hub 16 fixed to a central shaft 18.

A rubber ball 20 is rigidly mounted on each end of shaft 18, a handle element 22 is slidably mounted on shaft 18 between rotor 12 and each ball 20. A pair of elastic strings 24 are integrally attached to each ball 20 and are connected between ball 20 and each handle 22 on opposite sides of shaft 18 by passing the ends of each string 24 through parallel bores in each handle 22 and knotting the strings as shown at 26.

In operation, handles 22 are rotated in the same direction about shaft 18 to twist the strings 24 on opposite sides of shaft 18 together. The handles 22 are then held as the strings alternately untwist and retwist together in an opposite direction rotating balls 20 and shaft 18 accordingly and are moved axially of the shaft toward and away from each other. Rotation of the shaft 18 will also rotate the rotor 12 fixed to shaft 18 in opposite directions providing an interesting and enjoyable motion and effect.

I claim:

1. A toy comprising a shaft, a rotor fixed to, and on said shaft intermediate the ends of said shaft, first and second elongate handle members, each handle member having a bore therethrough transverse to the elongate axis of said handle member and intermediate the ends of said handle member, each handle member being received on said shaft on one side of said rotor, a portion of said shaft on one side of said rotor being received through said bore of one of said handle members, the diameter of each said bore being larger than said shaft to permit slidable and rotatable movement of said shaft relative to said handle member, first and second end caps each mounted on one end of said shaft to maintain one of said handle members on one portion of said shaft between said rotor and one end of said shaft, two pairs of strings, each pair being connected at one end to one end of one of said handle members and at the other end to said shaft and including a first string attached at one end to one portion of one of said handle members on one side of said bore at a point spaced from said bore therein and a second string attached at one end to the other portion of said one of said handle members on the other side of said bore therein at a point spaced from said bore and each of said handle members, in the vicinity of said bore therein, being sized and configured so as to be gripped easily by a child's hand and so that, when gripped, said rotor can be rotated to twist said strings and then, continuous reciprocal rotating movement of said rotor and shaft can be achieved by moving said handle members axially of said shaft toward and away from each other.

2. The toy according to claim 1 wherein each of said end caps includes a ball mounted on one end of said shaft.

3. The toy according to claim 1 wherein said rotor includes: a wheel, a plurality of spokes on said wheel, and a hub connected to said spokes and fixed to said shaft.

4. The toy according to claim 1 wherein said strings are elastic.

5. The toy according to claim 1 wherein said strings are of equal length and said points of attachment on said handle members are all spaced the same distance from the axis of said bore in said handle member.

* * * * *